US007578772B2

(12) United States Patent
Lippitt

(10) Patent No.: US 7,578,772 B2
(45) Date of Patent: Aug. 25, 2009

(54) ADJUSTABLE WEIGHT

(75) Inventor: Raymond F. Lippitt, Bethesda, MD (US)

(73) Assignee: Stamina Products, Inc., Springfield, MO (US)

( * ) Notice: Subject to any disclaimer, the term of this patent is extended or adjusted under 35 U.S.C. 154(b) by 0 days.

(21) Appl. No.: 11/650,438

(22) Filed: Jan. 8, 2007

(65) Prior Publication Data

US 2007/0161474 A1 Jul. 12, 2007

Related U.S. Application Data

(60) Provisional application No. 60/757,028, filed on Jan. 9, 2006.

(51) Int. Cl.
*A63B 21/072* (2006.01)

(52) U.S. Cl. ..... 482/108; 482/106; 482/107

(58) Field of Classification Search ..... 482/93–95, 482/97, 98, 99, 106–109, 908, 92
See application file for complete search history.

(56) References Cited

U.S. PATENT DOCUMENTS

| | | | | |
|---|---|---|---|---|
| 4,529,198 | A | 7/1985 | Hettick, Jr. | |
| 5,839,997 | A * | 11/1998 | Roth et al. | 482/107 |
| 5,876,313 | A | 3/1999 | Krull | |
| 6,039,678 | A | 3/2000 | Dawson | |
| 6,228,003 | B1 | 5/2001 | Hald et al. | |
| 6,261,022 | B1 | 7/2001 | Dalebout et al. | |
| 6,416,446 | B1 | 7/2002 | Krull | |
| 6,500,101 | B1 | 12/2002 | Chen | |
| 6,540,650 | B1 | 4/2003 | Krull | |
| 6,656,093 | B2 | 12/2003 | Chen | |
| 6,899,661 | B1 | 5/2005 | Krull | |

(Continued)

*Primary Examiner*—Loan H Thanh
*Assistant Examiner*—Daniel F Roland
(74) *Attorney, Agent, or Firm*—Pillsbury Winthrop Shaw Pittman LLP

(57) ABSTRACT

An exercising apparatus which comprises first and second sets of weights, each of which has an opening extending inwardly from a periphery thereof defined by opposed surfaces. An elongated tubular assembly is provided which has a longitudinal axis and includes exterior surfaces constructed and arranged to provide a central surface area configured to be manually engaged by a user and first and second surface areas on opposite sides of the central surface area configured to enter the openings of the first and second sets of weights into operative positions therein. The tubular assembly includes first and second sets of locking elements mounted within the first and second surface areas thereof for movement between weight releasing positions disposed within their respective first and second surface areas and weight locking positions extending partially outwardly of the respective first and second surface areas. The opposed surfaces of the weights have lock element receiving recesses therein. The tubular assembly also includes a weight selector member extending within the surface areas and mounted for movement about the longitudinal axis between a number of successive angular operative positions equal to the number of weights in each set. The weight selector member is interrelated to the locking elements such that when moved through the successive angular operative positions, the locking elements associated with successive weights of the first and second sets are moved into and retained in locking positions disposed within the lock receiving recesses. The arrangement is such that a selected number of weights of each set can be locked to the tubular assembly depending upon the operative position within the successive number of operative positions that the selector member is moved into.

10 Claims, 9 Drawing Sheets

U.S. PATENT DOCUMENTS

| | | | | |
|---|---|---|---|---|
| 7,025,713 | B2 | 4/2006 | Dalebout et al. | |
| 7,090,625 | B2 | 8/2006 | Chermack | |
| 7,121,988 | B2 | 10/2006 | Walkerdine | |
| 7,137,932 | B2 | 11/2006 | Doudiet | |
| 7,223,214 | B2 | 5/2007 | Chen | |
| 7,485,077 | B2 * | 2/2009 | Chen | 482/108 |
| 2002/0183174 | A1 | 12/2002 | Chen | |
| 2003/0148862 | A1 | 8/2003 | Chen et al. | |
| 2004/0005969 | A1 | 1/2004 | Chen | |
| 2005/0277525 | A1 * | 12/2005 | Liu | 482/107 |
| 2006/0105891 | A1 | 5/2006 | Cappellini et al. | |
| 2007/0184945 | A1 * | 8/2007 | Lin | 482/107 |

* cited by examiner

ADJUSTABLE WEIGHT

RELATED APPLICATIONS

This application claims priority to U.S. Provisional Application No. 60/757,028, filed Jan. 9, 2006, which is incorporated herein by reference in its entirety.

BACKGROUND OF THE INVENTION

This application relates to an exercising apparatus and more particularly to an exercising apparatus of the manually moved bar bell assembly type.

1. Field of the Invention

This application relates to an exercising apparatus and more particularly to an exercising apparatus of the manually moved bar bell assembly type.

2. Description of Related Art

Examples of the type of exercise apparatus herein contemplated are disclosed in U.S. Pat. Nos. 5,839,997 and 5,876,313. In general, the apparatus includes a base which is adapted to receive two sets of weights in predetermined positions with the weights having openings extending downwardly from the periphery so as to receive the opposite end portions of a tubular assembly therein in an operative position. The tubular assembly provides a central manually engageable portion and a locking mechanism on opposite sides thereof capable of affecting a selective locking action with respect to the weights. While the units of the prior art have proven to be advantageous, nevertheless there is always the need to improve on the performance and cost-effectiveness of such apparatus.

BRIEF SUMMARY OF THE INVENTION

An object of the present invention is to provide such improvements. In accordance with the principles of the present invention, this objective is achieved by providing an exercising apparatus which comprises first and second sets of weights, each of which has an opening extending inwardly from a periphery thereof defined by opposed surfaces. An elongated tubular assembly is provided which has a longitudinal axis and includes exterior surfaces constructed and arranged to provide a central surface area configured to be manually engaged by a user and first and second surface areas on opposite sides of the central surface area configured to enter the openings of the first and second sets of weights into operative positions therein. The tubular assembly includes first and second sets of locking elements mounted within the first and second surface areas thereof for movement between weight releasing positions disposed within their respective first and second surface areas and weight locking positions extending partially outwardly of the respective first and second surface areas. The opposed surfaces of the weights have lock element receiving recesses therein. The tubular assembly also includes a weight selector member extending within the surface areas and mounted for movement about the longitudinal axis between a number of successive angular operative positions equal to the number of weights in each set. The weight selector member is interrelated to the locking elements such that when moved through the successive angular operative positions, the locking elements associated with successive weights of the first and second sets are moved into and retained in locking positions disposed within the lock receiving recesses. The arrangement is such that a selected number of weights of each set can be locked to the tubular assembly depending upon the operative position within the successive number of operative positions that the selector member is moved into.

DETAILED DESCRIPTION OF THE INVENTION

Figure 1:
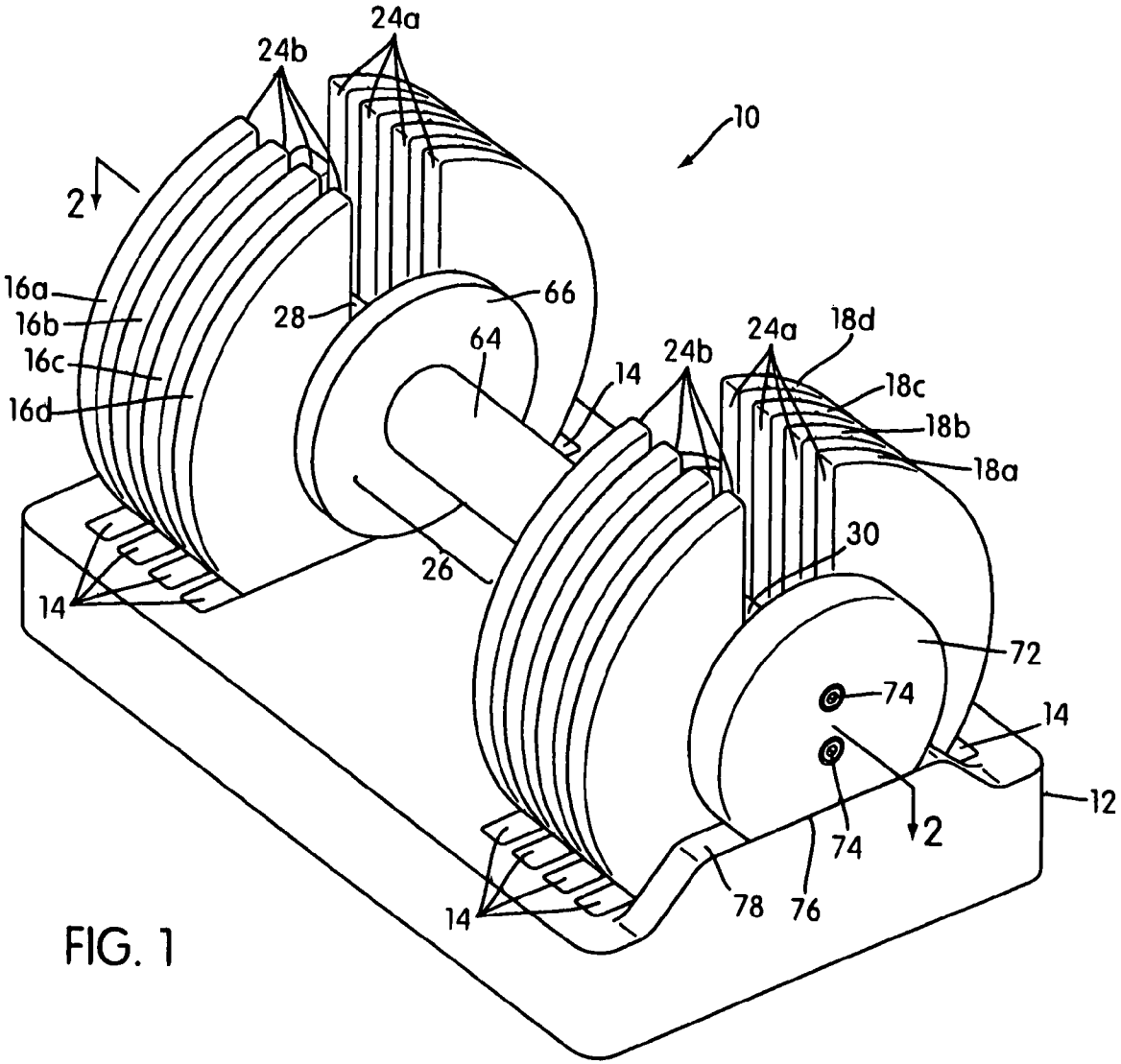
FIG. 1. is a perspective view of a exercising apparatus embodying the principles of the present invention showing the position of the parts in one operative position of the weight selector member thereof.

Referring now more particularly to FIG. 1, there is shown therein an exercising apparatus, generally indicated at 10, embodying the principles of the present invention. In general, the apparatus 10 includes a base structure 12 having surfaces 14 configured to receive first and second sets of weights in pre-determined positions so as to cooperate with a elongated tubular assembly, generally indicated at 20. The tubular assembly 20 can be moved into cooperating relation with both the first and second sets of weights so as to be selectively locked with any number of weights in the first and second sets 16 and 18 depending upon the position of a weight selector member 22 embodied within the elongated tubular assembly 20.

In the embodiment shown, there are four weights in each set 16 and 18, which are designated by subscript letters a, b, c and d. Each weight has a radial opening 24 therein extending inwardly from a periphery thereof defined by opposed surfaces 24*a* and 24*b*. The elongated tubular assembly 20 has a longitudinal axis and includes exterior surfaces constructed and arranged to provide a central surface area 26 configured to be manually engaged by a user and first and second surface areas 28 and 30 on opposite sides of the central surface area 26 configured to enter the openings 24 of the first and second sets of weights 16 and 18, respectively, in operative positions therein when positioned in the aforesaid predetermined relationship on the base structure 12.

The tubular assembly 20 includes a locking mechanism, generally indicated at 32, which includes first and second sets of locking elements 34 preferably in the form of balls made of a hard material such as steel or the like. Each set of balls 34 includes four pairs of opposed balls 34 having subscript letters corresponding with the subscript letters of the weights 16 and 18. The balls 34 are mounted within passages 36 formed in the tubular assembly 20 so as to be movable between weight releasing positions disposed within the respective first and second surface areas 28 and 30 and weight locking positions extending partially outwardly of the respective first and second surface areas 28 and 30. The passages 36 within which the balls 34 are mounted are formed within an outer tubular structure 38. The outer tubular structure 38 forms a part of the tubular assembly 20. The selector member 22 is mounted within the outer tubular structure 38 for movement into a number of operative positions equal in number to the number of weights in each set 16 and 18.

The outer tubular structure 38 includes an outer tubular member 40 having surfaces defining radially inward portions of the passages 36 which open radially outward, but allow only partial movement in a radially inwardly direction. To complete the passages, there are provided a pair of opposed plates 42, each providing plate portions with surfaces for completing the radially outward portions of the passages 36 associated with each set of weights 16 and 18. The outer portion of the passages 36 are configured to provide for limited partial movement of the balls 34 outwardly.

As shown, the opposed surfaces 24 of each of the weights 16-18 are formed with locking element receiving recesses or depressions 44. Preferably, the recesses 44 are domed-shaped to receive a portion of an associated ball 34.

The plates 42 are detachably fixed to the outer tubular member 40 by any suitable fasteners 43 enabling the plates 42 to be (1) detached from the outer tubular member 40 to allow the balls 34 to be inserted within the passages 36 and (2) attached to the outer tubular member 4 to retain the balls 34 within the passages 36. The plates 42, when attached to the outer tubular member 40 form a part of the outer tubular structure 38.

The selector member 22 can be retained in a selected operative position by any suitable means. Such means may be a simple spring pressed indexing ball carried by the outer tubular structure 38 so as to move into successive ball receiving recesses on the periphery of the selector member 22 as the selector member 22 is rotated.

Figure 8:
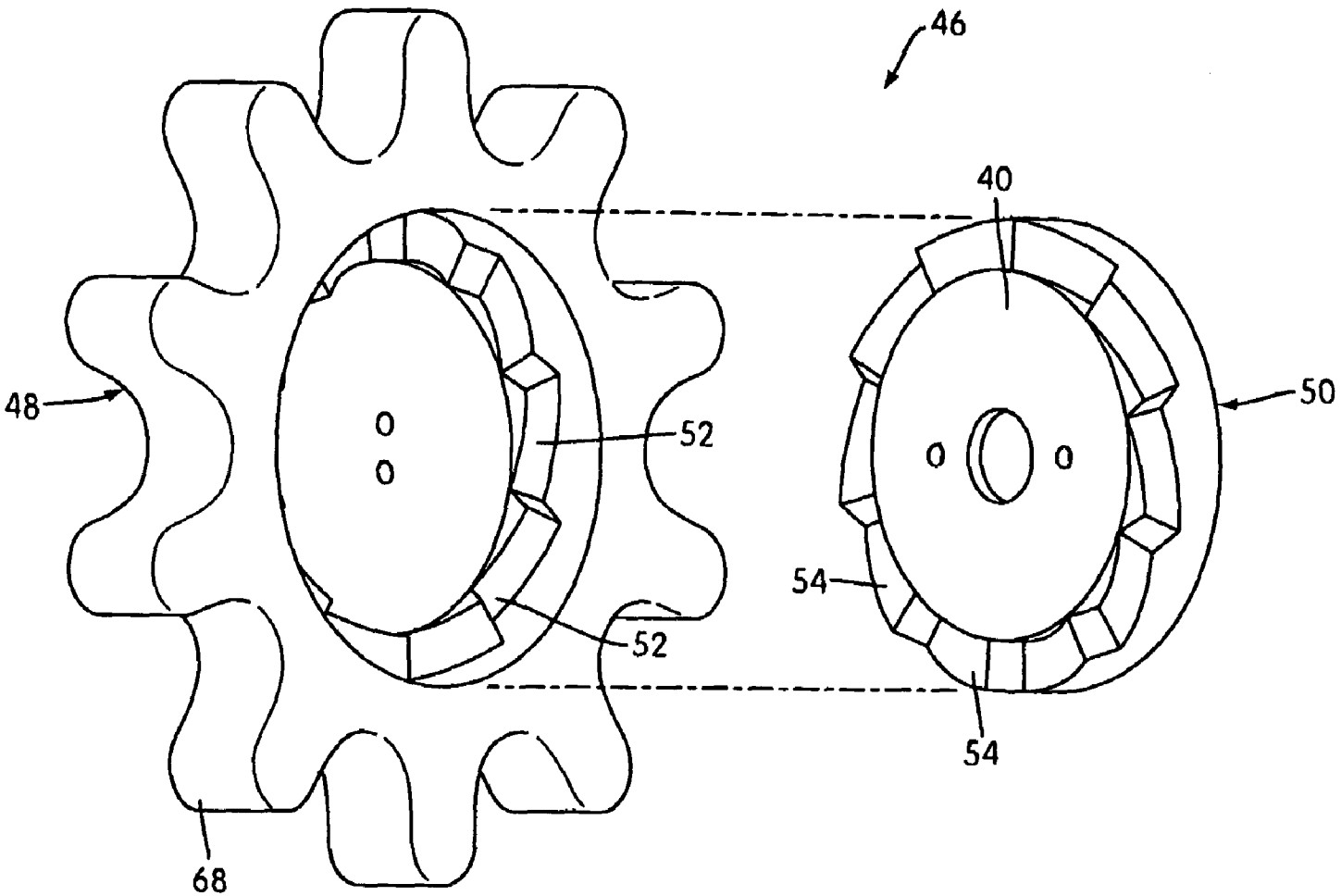
FIG. 8 is a composite perspective view of the annular ratcheting components of the apparatus.

Alternatively, the indexing ball, rather than being spring-biased could be manually moved into and out of the recesses, see, for example, U.S. Patent Application Publication No. 2002/0183174. Another possibility is to provide a ball indexing member which is moved between operative and inoperative positions as the assembly 10 is moved into and out of operating position with respect to the base structure 12 so that indexing movement can only take place when the assembly 10 is in an operative position on the base structure 12. See U.S. Pat. No. 6,540,650. The preferred arrangement is to provide for a spring-biased ratcheting indexed movement. Accordingly, there is provided a spring-biased annular ratcheting assembly, generally indicated at 46, which, as best shown in FIG. 8, includes a pair of annular ratcheting elements 48 and 50 having opposed faces formed with ratcheting teeth 52 and 54, respectively. The ratcheting member 48 is affixed, as by a pair of bolts 53 (FIG. 3), to one end of the selector member 22 while the other ratcheting member 50 is connected in fixed relation to the outer tubular member 40. The outer tubular member 40 and the selector member 22 are also mounted by a pair of balls 55 relative to longitudinal movement with respect to one another. A coil spring 56 is provided between a shoulder 58 on the end of the selector member 22 which faces toward the ratchet member 48 fixed to the end thereof. The opposite end of the coil spring 56 engages the other annular ratcheting member 50 which is fixed to the end of the outer tubular member 40. Spring 56 thus acts to bias the ratcheting members 40 and 50 together so that the ratcheting teeth 52 and 54 interengage.

As previously indicated, the selector member 22 has four successive operative positions which correspond with the retention of one, two, three or four of the weights of each set 16 and 18. As shown, in the first of the four positions, only the outer weights 16*a* and 18*a* are retained. In the second position, outer weights 16*a-b* and 18*a-b* are retained. In the third position, weights 16*a-c* and 18*a-c* are retained and in the fourth position, all the weights of both sets 16 and 18 are retained. Preferably, the selector member 22 has a fifth position which is essentially an inoperative position in which none of the weights of both sets are retained To accomplish these functions, the selector member 22 includes first and second sets of cam surfaces 60 and 62.

The cam surfaces 60 and 62 are configured to accomplish weight retention by cam surface portions which extend radially outwardly sufficiently to move and/or maintain the associated balls 34 outwardly of the associated passages 36.

Figure 4:
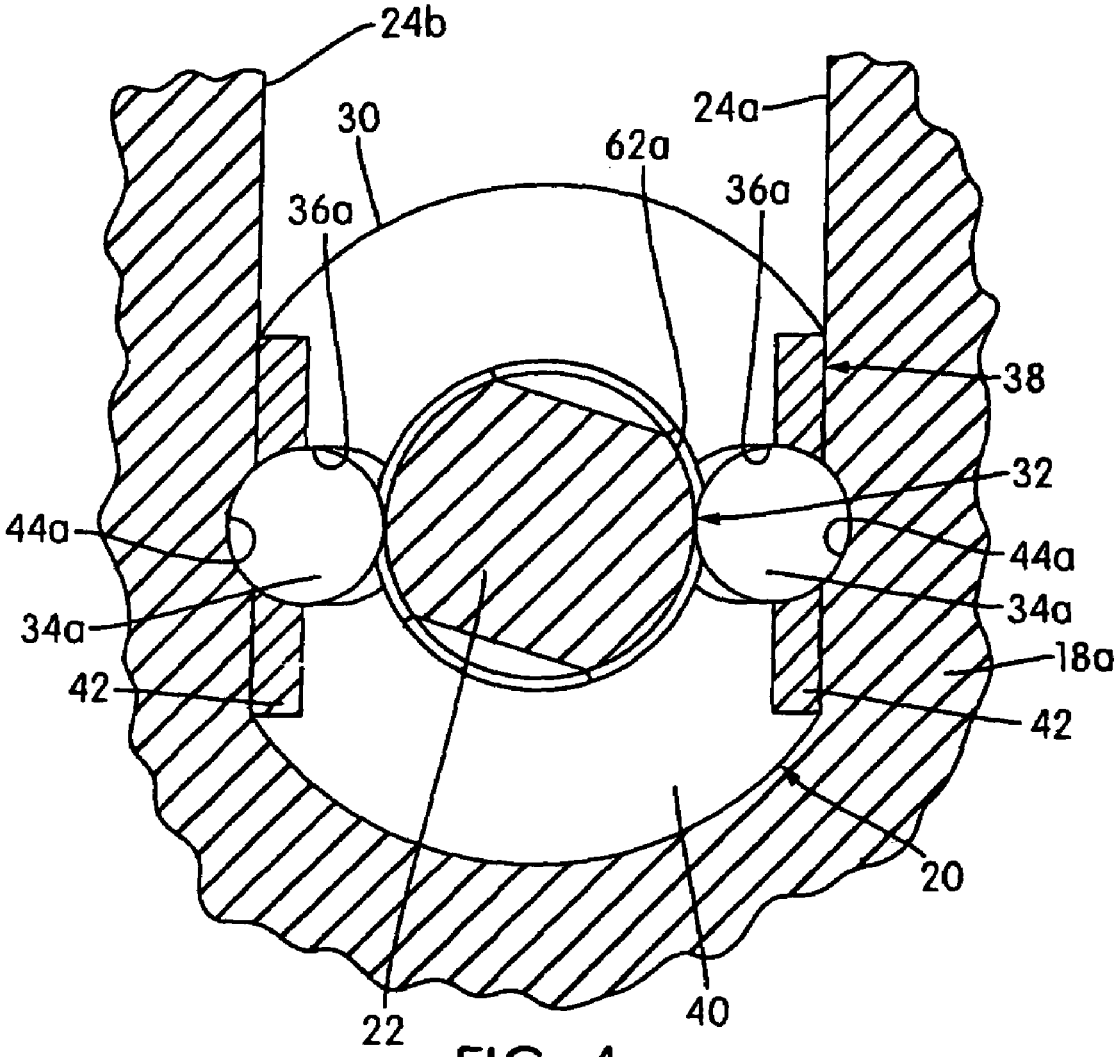
FIG. 4 is a sectional view taken along the line 4-4 of FIG. 2.
Figure 5:
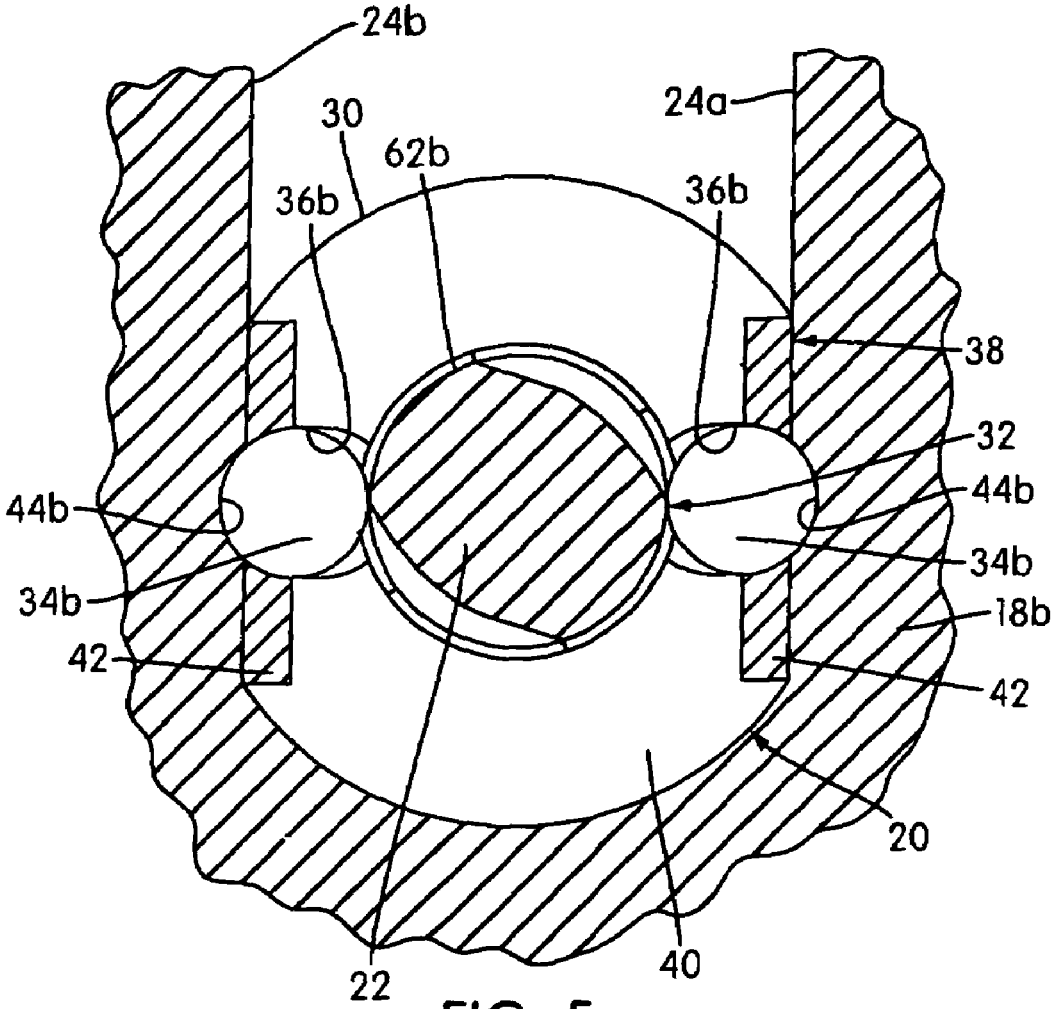
FIG. 5 is a sectional view taken along the line 5-5 of FIG. 2.
Figure 6:
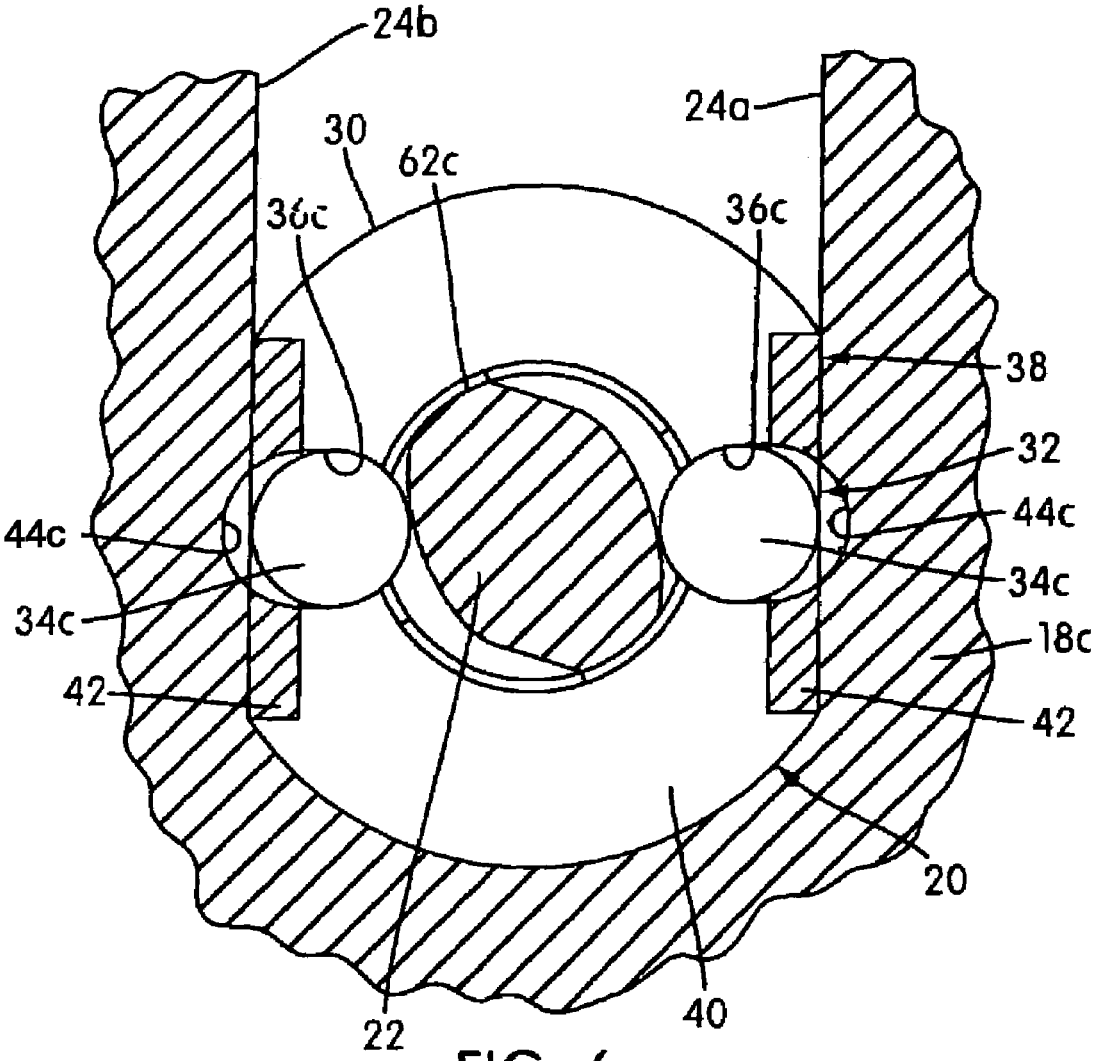
FIG. 6 is a sectional view taken along the line 6-6 of FIG. 2.
Figure 7:
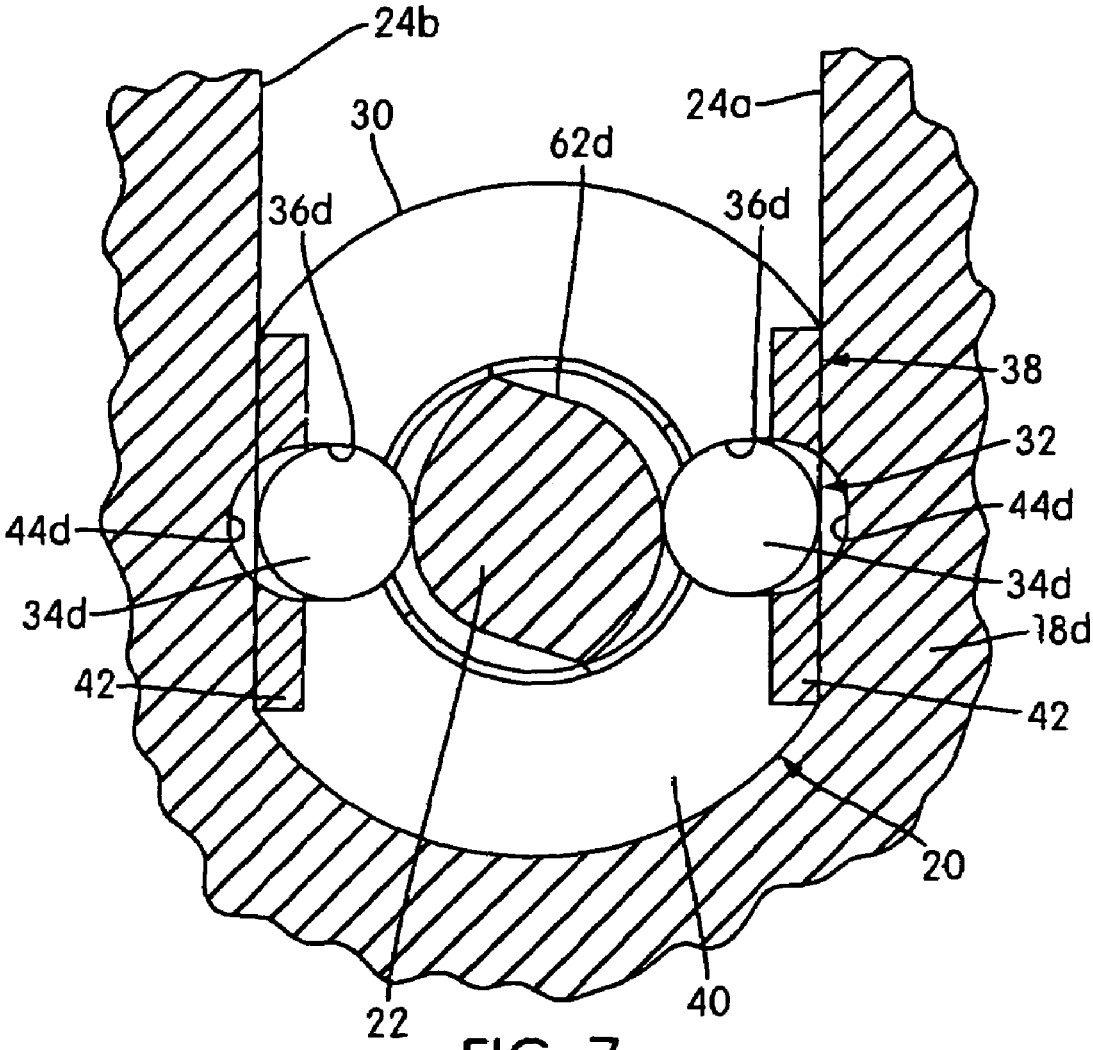
FIG. 7 is a sectional view taken along the line 7-7 of FIG. 2.

FIG. 4 illustrates that cam surface 62*a* has radially outwardly extending cam portions of the greatest annular extent. FIG. 5 illustrates that cam surface 62*b* has a somewhat lesser annular extent. FIG. 6 illustrates that cam surface 62*c* is even less in annular extent while FIG. 7 illustrates that cam surface 62*d* is of minimum annular extent. The annular extent of cam surfaces 60*a-d* correspond to those of cam surfaces 62*a-d*. In addition, all of the cam surfaces 60 and 62 have a slope in the same longitudinal or axial direction.

As shown, all of the cam surfaces are symmetrical about a diameter line so that it is possible to repetitiously go through the four operative positions and fifth inoperative position by rotating the selector member 22 in one direction. Consequently, in one revolution of the selector member 22 has ten indexed positions or two repetitions of the five positions.

While the central surface area 26 of the tubular assembly 20 could be provided by the central exterior surface of the outer tubular member 40, preferably the central surface area 26 is provided by the exterior periphery of a central cylindrical member 64 rotatably mounted on the central section of the outer tubular member 40 and retained in a central position by a pair of annular flange elements 66 suitably fixed to outer tubular member 40 on opposite sides of the cylindrical member 64.

Figure 3:
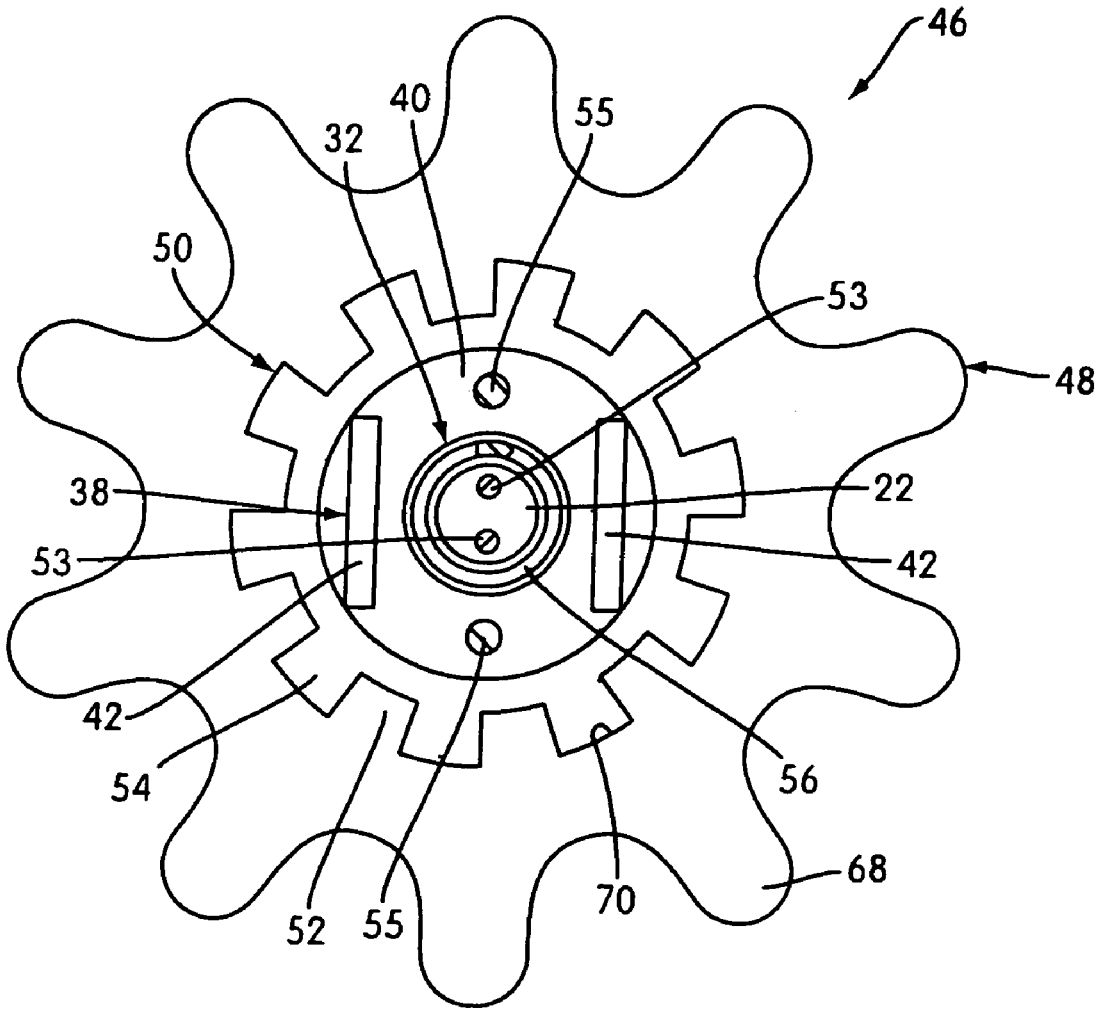
FIG. 3 is a sectional view taken along the line 3-3 of FIG. 2.

To aid in moving the selector member 22 into successive operative positions thereof, a spoked manually engagable selector moving member 68 is splined, as indicated at 70 in FIG. 3, to the ratcheting member 48 fixed on the end of the selector member 22. An outer tubular structure holding member 72 is suitably fixed as by bolts 74 (FIG. 1), to the outer tubular member 40. As best shown in FIG. 1, the holding member 72 is formed with a surface 76 which cooperates with a surface 78 on the base structure 12 to prevent rotational movement of the outer tubular structure 38 during rotational movement of the selector moving member 68 when the exercise apparatus 10 is in operative position with respect to the weights 16 and 18 disposed in operative positions on the base structure 12.

OPERATION

FIG. 1 shows the adjustable weight assembly 10 mounted on its base structure 12. The particular setting of the selector member 22 is to retain the two outermost weights of each set 16*a-b* and 18*a-b* as a bar bell apparatus 10 and leave the two innermost weights of each set 16*c-d* and 18*c-d* with the base structure 12 when the bar bell apparatus 10 is lifted off the base structure 12.

The weights 16*a-b* and 18*a-b* are retained because the two balls 34*a-b* associated with each of the weights 16*a-b* and 18*a-b* are disposed within dome-shaped recesses 44*a-b* in opposed surfaces 24*a-b* of the central radial opening in the weights. The balls 24*a-b* are weight-bearing because they are held by a tubular assembly 20 in engagement with cam surfaces 60*a-b* and 62*a-b* on a rotating central selector member 22 housed in the tubular assembly 20 and therefore cannot move, as shown in FIGS. 2, 4 and 5.

Figure 2:
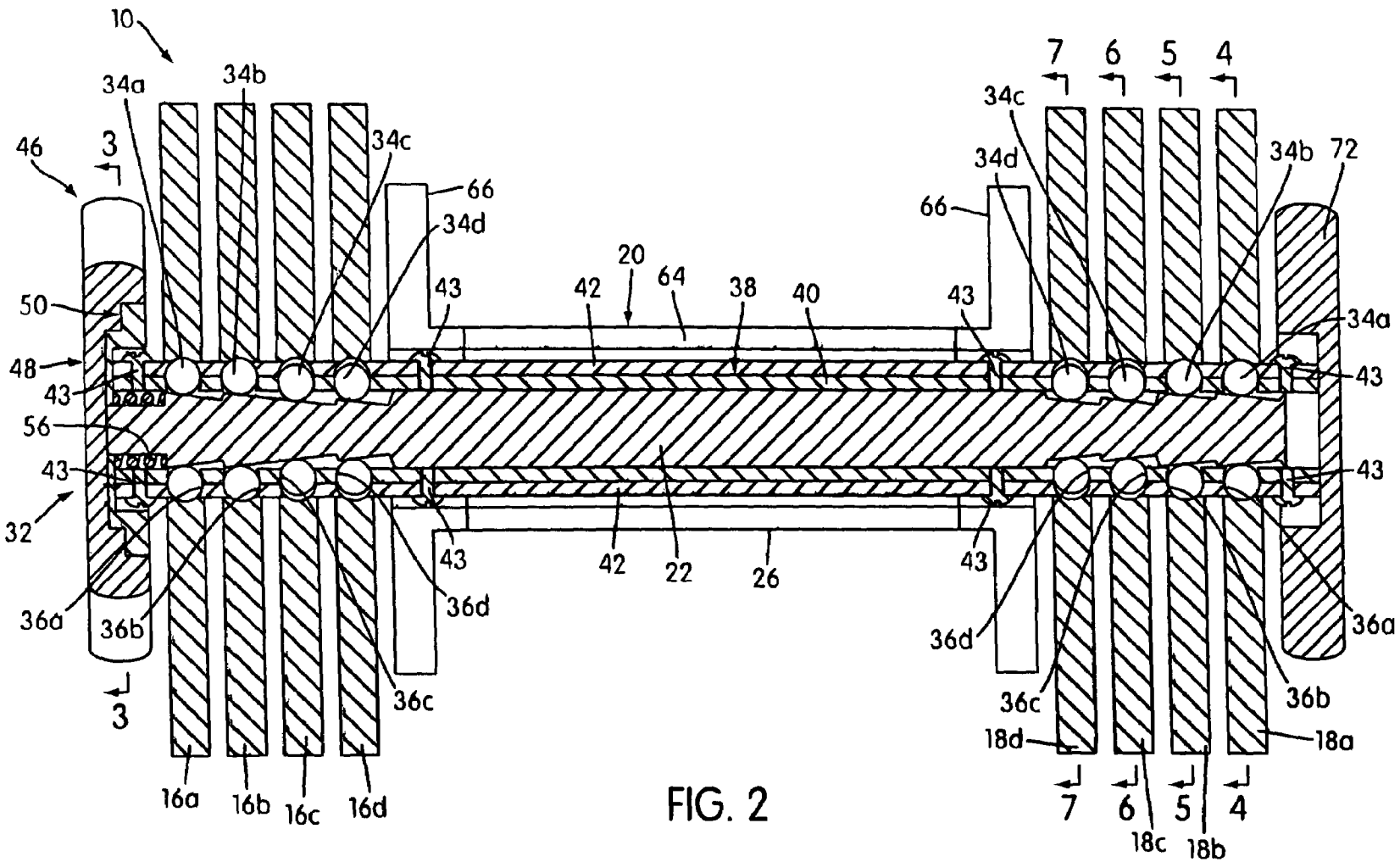
FIG. 2 is an enlarged cross-sectional view taken along the line 2-2 of FIG. 1.
Figure 9:
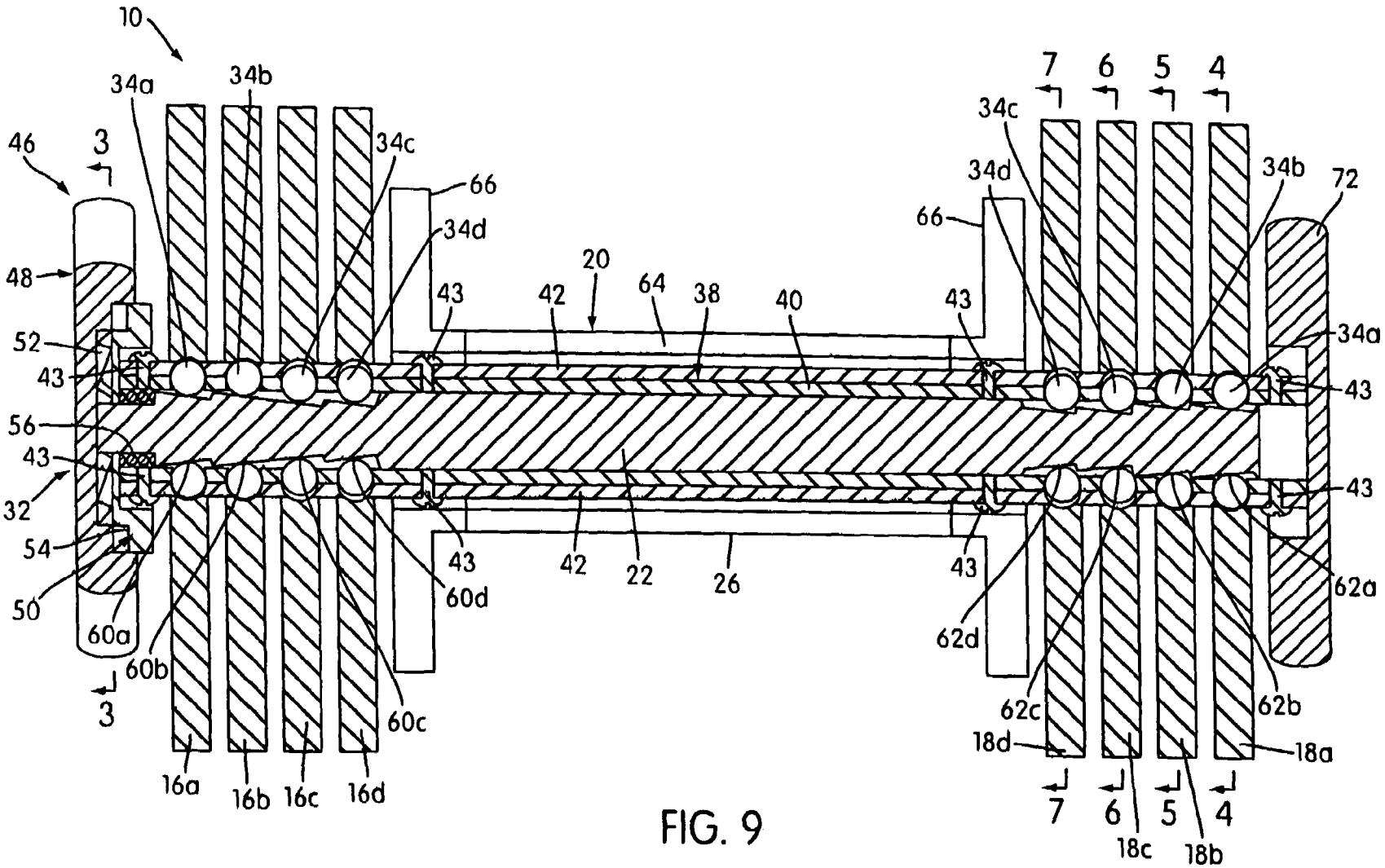
FIG. 9 is a view similar to FIG. 2 showing the position of the parts when the weight selector member is between indexed operative positions thereof.

The rotating central selector member 22 is resiliently retained in position by a compression coil spring 56 acting on a shoulder 58 on the left end thereof as shown in FIGS. 2 and 9. The spring 56 also acts against a rotating ratchet wheel or ratcheting member 50 (on the right in FIG. 8) fixed to the left end of the ball retaining tubular assembly 20 within which the central selector member 22 is mounted both for rotation and limited axial movement.

The end of the selector member 22 extends through the rotary ratchet wheel 50 and is fixed to a ratcheting member 48 (on the left in FIG. 8). A turning wheel 68, fixed to the ratcheting member 48, serves as a moving member for the selector member 22 and has exterior finger entering notches which facilitate turning. The interior inner portion of the turning wheel 68 is formed by the ratcheting member 48 which has annular ratchet surfaces 62 as shown at the left in FIG. 8.

The spring 56 biases the annular ratchet surfaces 52 of the turning wheel 68 into engagement with the cooperating ratcheting surfaces 54 of the rotary ratchet wheel 50 so that the two are retained in one of ten indexed positions.

The shape and engagement of the ratchet teeth 52 and 54 are such that the turning wheel 68 can only be turned in one direction which is clockwise as shown in FIGS. 4-7. These figures illustrate an operative position of the selector member 22 where four weights 16*a-b* and 18*a-b* are retained. FIG. 4 shows that after a 36° clockwise turn of the turning wheel 48, the two weights 16*c* and 18*c* next to the outermost weights 16*a-b* and 18*a-b* will be released at position 1 wherein only the two outermost weights are retained. FIG. 5 shows that after another 36° (72° from that shown) clockwise turn of the turning wheel 48, the last two outermost weights 16*d* and 18*d* will be released. FIG. 6 illustrates that the next to innermost weights 16*c* and 18*c* are released, but it can be seen that 36° before reaching the position shown, the balls 34*c* would be engaged and the corresponding weights 16*c* and 18*c* would have been retained. Finally, FIG. 7 illustrates that the innermost weights 16*d* and 18*d* are released, but it can be seen that 72° before reaching the position shown, the balls 34*d* would be engaged and the corresponding weights 16*d* and 18*d* would have been retained.

Consequently, it can be seen that as the turning wheel 65 is turned, the selector member 22 is moved successively through four operative positions and an unoperative position, and then repeated. Obviously, only five positions are required rather than ten. Ten gets one indexed position done in a 36° turn. The invention contemplates a 72° turn.

During a 36° turn from any indexed position, the slant of the inter-engaging ratchet teeth 52 and 54 will initiate an axial movement of the central selector member 22 against the bias of the spring 56, as it rotates. The cam surfaces 60 and 62 all fall off during this axial movement so that when the next indexed position is reached, a rapid return axial movement under the bias of the spring 56 takes place and only those cam surfaces 60*a-d* and 62*a-d* intended for retaining balls 34 will be brought into ball retaining engagement.

Selector movement should only take place when the total bar bell apparatus 10 is properly seated on the base structure 12. FIG. 1 illustrates that a right hand holding member 72 is fixed to the ball retaining tubular assembly 20 shown at the right in FIGS. 2 and 9. The holding member 72 is round, but has a flat surface 76 which engages a flat surface 28 on the base structure 12 when the total bar bell apparatus 10 is properly mounted on the base structure 12. This enables the user to effect an indexing movement with one hand since the inter-engaging flat surfaces 76 and 78 will hold the ball retaining tubular assembly 20 from moving as the turning wheel 48 is turned.

What is claimed is:

1. An exercising apparatus comprising:

first and second sets of weights, each weight of each set having an opening extending inwardly from a periphery thereof defined by opposed surfaces, an elongated tubular assembly having a longitudinal axis and including exterior surfaces therearound constructed and arranged to provide a central surface area configured to be manually engaged by a user and first and second surface areas on opposite sides of said central surface area configured to enter the openings of said first and second sets of weights into operative positions therein, said tubular assembly including first and second sets of locking elements mounted within the first and second surface areas thereof for movement between weight releasing positions disposed within the respective first and second surface areas and a weight locking position extending partially outwardly of the respective first and second surface areas, the opposed surfaces of said weights having lock element receiving recesses therein, wherein said first and second sets of locking elements are configured to be moveable with respect to said elongated tubular assembly and wherein each of said locking elements are configured to engage an associated weight of said first and second sets of weights, said tubular assembly also including a weight selector member extending within said surface areas and mounted for movement about the longitudinal axis thereof between a number of successive angular operative positions equal to the number of weights in each set, said weight selector member being interrelated to said locking elements such that when moved through said successive operative positions the locking elements associated with successive weights of said first and second sets are moved into and retained in locking positions disposed within the lock receiving recesses thereof so that a selected number of weights of each set can be locked to said tubular assembly depending upon the operative position said selector member is moved into, wherein said locking elements move in a radial direction with respect to said longitudinal axis when moved between the locking and releasing positions thereof.

2. An exercising apparatus as defined in claim 1, wherein the lock receiving recesses are formed in the opposed surfaces of each weight and opposed locking elements are provided for movement into and out of said opposed lock receiving recesses of each weight.

3. An exercising apparatus as defined in claim 1, wherein each weight is generally disk-shaped with the opening thereof being in the form of a slot extending radially between a periphery and a center thereof.

4. An exercising apparatus as defined in claim 1, wherein said selector member is retained in each of said operative positions in indexed fashion.

5. An exercising apparatus as defined in claim 1, wherein said exercising apparatus also includes a base having surfaces for receiving and releasably retaining individual weights of said first and second sets in predetermined positions allowing first and second surface areas of said tubular assembly to enter the openings of the weights of the first and second set into the operative positions thereof.

6. An exercising apparatus, comprising:

first and second sets of weights, each weight of each set having an opening extending inwardly from a periphery thereof defined by opposed surfaces, an elongated tubular assembly having a longitudinal axis and including exterior surfaces therearound constructed and arranged to provide a central surface area configured to be manually engaged by a user and first and second surface areas on opposite sides of said central surface area configured to enter the openings of said first and second sets of weights into operative positions therein, said tubular assembly including first and second sets of locking elements mounted within the first and second surface areas thereof for movement between weight releasing positions disposed within the respective first and second surface areas and a weight locking position extending partially outwardly of the respective first and second surface areas, the opposed surfaces of said weights having lock element receiving recesses therein, wherein said first and second sets of locking elements are configured to be moveable with respect to said elongated tubular assembly and wherein each of said locking elements are configured to engage an associated weight of said first and second sets of weights, said tubular assembly also including a weight elector member extending within said surface areas and mounted for movement about the longitudinal axis thereof between a number of successive angular operative positions equal to the number of weights in each set, said weight selector member being interrelated to said locking elements such that when moved through said successive operative positions the locking elements associated with successive weights of said first and second sets are moved into and retained in locking positions disposed within the lock receiving recesses thereof so that a selected number of weights of each set can be locked to said tubular assembly depending upon the operative position said selector member is moved into, wherein said selector member includes first and second sets of peripheral cams surfaces, each set of cam surfaces includes releasing portions configured to allow corresponding locking elements to move radially inwardly and locking portions configured to move corresponding locking elements radially outwardly into the locking positions thereof.

7. An exercising apparatus, comprising:

first and second sets of weights, each weight of each set having an opening extending inwardly from a periphery thereof defined by opposed surfaces, an elongated tubular assembly having a longitudinal axis and including exterior surfaces therearound constructed and arranged to provide a central surface area configured to be manually engaged by a user and first and second surface areas on opposite sides of said central surface area configured to enter the openings of said first and second sets of weights into operative positions therein, said tubular assembly including first and second sets of locking elements mounted within the first and second surface areas thereof for movement between releasing positions disposed within the respective first and second surface areas and a weight locking position extending partially outwardly of the respective first and second surface areas, the opposed surfaces of said weights having lock element receiving recesses therein, wherein said first and second sets of locking elements are configured to be moveable with respect to said elongated tubular assembly and wherein each of said locking elements are configured to engage an associated weight of said first and second sets of weights, said tubular assembly also including a weight selector member extending within said surface areas and mounted for movement about the longitudinal axis thereof between a number of successive angular operative positions equal to the number of weights in each set, said weight selector member being interrelated to said locking elements such that when moved through said successive operative positions the locking elements associated with successive weights of said first and second sets are moved into and retained in locking positions disposed within the lock receiving recesses thereof so that a selected number of weights of each set can be locked to said tubular assembly depending upon the operative position said selector member is moved into, wherein said tubular assembly includes an outer tubular structure within which said selector member is mounted for movement about said longitudinal axis into said number of operative positions, wherein said outer tubular structure defines first and second sets of passages configured to retain said first and second sets of locking elements for radially inward movement into engagement with a first and second set of cam surfaces and for radially outward movement by said first and second set of cam surfaces into the locking positions thereof.

8. An exercising apparatus, comprising:

first and second sets of weights, each weight of each set having an opening extending inwardly from a periphery thereof defined by opposed surfaces, an elongated tubular assembly having a longitudinal axis and including exterior surfaces therearound constructed and arranged to provide a central surface area configured to be manually engaged by a user and first and second surface areas on opposite sides of said central surface area configured to enter the openings of said first and second sets of weights into operative positions therein, said tubular assembly including first and second sets of locking elements mounted within the first and second surface areas thereof for movement between weight releasing positions disposed within the respective first and second surface areas and a weight locking position extending partially outwardly of the respective first and second surface areas, the opposed surfaces of said weights having lock element receiving recesses therein, said tubular assembly also including a weight selector member extending within said surface areas and mounted for movement about the longitudinal axis thereof between a number of successive angular operative positions equal to the number of weights in each set, said weight selector member being interrelated to said locking elements such that when moved through said successive operative positions the locking elements associated with successive weights of said first and second sets are moved into and retained in locking positions disposed within the lock receiving recesses thereof so that a selected number of weights of each set can be locked to said tubular assembly depending upon the operative position said selector member is moved into, wherein said tubular assembly includes an outer tubular structure within which said selector member is mounted for movement about said longitudinal axis into said number of operative positions, wherein said outer tubular structure defines first and second sets of passages configured to retain said first and second sets of locking elements for radially inward movement into engagement with a first and second set of cam surfaces and for radially outward movement by said first and second set of cam surfaces into the locking positions thereof, wherein said outer tubular structure includes an outer tubular member having surfaces defining a radially inward portion of each passage and detachably fixed flat plate portions having surfaces defining a remaining radially outward portion of each passage.

9. An exercising apparatus, comprising:

first and second sets of weights, each weight of each set having an opening extending inwardly from a periphery thereof defined by opposed surfaces, an elongated tubular assembly having a longitudinal axis and including exterior surfaces therearound constructed and arranged to provide a central surface area configured to be manual engaged by a user and first and second surface areas on opposite sides of said central surface area configured to enter the openings of said first and second sets of weights into operative positions therein, said tubular assembly including first and second sets of locking elements mounted within the first and second surface areas thereof for movement between weight releasing positions disposed within the respective first and second surface areas and a weight locking position extending partially outwardly of the respective first and second surface areas, the opposed surfaces of said weights having lock element receiving recesses therein, wherein said first and second sets of locking elements are configured to be moveable with respect to said elongated tubular assembly and wherein each of said locking elements are configured to engage an associated weight of said first and second sets of weights, said tubular assembly also including a weight selector member extending within said surface areas and mounted for movement about the longitudinal axis thereof between a number of successive angular operative positions equal to the number of weights in each set, said weight selector member being interrelated to said locking elements such that when moved through said successive operative positions the locking elements associated with successive weights of said first and second sets are moved into and retained in locking positions disposed within the lock receiving recesses thereof so that a selected number of weights of each set can be locked to said tubular assembly depending upon the operative position said selector member is moved into, wherein said selector member is retained in said operative positions in indexed fashion by a spring-biased annular ratcheting assembly operable to impart a spring-biased longitudinal indexing movement to said selector member during each successive movement thereof into an operative position thereof.

10. An exercising apparatus as defined in claim 9, wherein said spring pressed annular ratcheting assembly includes a mating pair of annular ratchet members fixed to said selector member and said outer tubular structure, respectively, having axially inter-engaging ratcheting surfaces and a spring acting axially between said selector member and said outer tubular structure in a direction to axially engage said annular ratcheting surfaces.

* * * * *